US008661633B2

(12) United States Patent
Filipek et al.

(10) Patent No.: US 8,661,633 B2
(45) Date of Patent: Mar. 4, 2014

(54) CASKET

(75) Inventors: Greg Filipek, Northville, MI (US); Daniel B. Sauger, Macomb, MI (US); Edward J. Engler, Sterling Heights, MI (US); Timothy M. Hamlock, Macomb, MI (US); Jeff Park, Milford, MI (US); Gary Vincent Borg, Berkley, MI (US); Franco Pahmer, Chattanooga, TN (US); Charles Dean Harrier, Montague, MI (US)

(73) Assignee: Genesis International, Inc., Indianapolis, IN (US)

( * ) Notice: Subject to any disclaimer, the term of this patent is extended or adjusted under 35 U.S.C. 154(b) by 144 days.

(21) Appl. No.: 13/278,536

(22) Filed: Oct. 21, 2011

(65) Prior Publication Data

US 2012/0096692 A1 Apr. 26, 2012

Related U.S. Application Data

(63) Continuation-in-part of application No. 13/080,306, filed on Apr. 5, 2011.

(60) Provisional application No. 61/321,099, filed on Apr. 5, 2010.

(51) Int. Cl.
*A61G 17/00* (2006.01)

(52) U.S. Cl.
USPC ..... 27/6; 27/16; 16/308

(58) Field of Classification Search
USPC ..... 27/2, 6, 10, 16, 17; 220/827, 845, 848; 16/308, 335, 336, 382, 387
See application file for complete search history.

(56) References Cited

U.S. PATENT DOCUMENTS

| | | | | | |
|---|---|---|---|---|---|
| 1,412,851 | A * | 4/1922 | Eliel | 228/173.6 |
| 2,372,412 | A * | 3/1945 | Wallace | 27/6 |
| 2,494,577 | A * | 1/1950 | Paden | 27/6 |
| 2,503,923 | A * | 4/1950 | Silvey | 336/75 |
| 2,511,871 | A * | 6/1950 | Paden | 27/17 |
| 5,448,810 | A * | 9/1995 | Mackirdy | 27/6 |
| 5,634,242 | A * | 6/1997 | Ferrari et al. | 16/370 |
| 5,813,100 | A * | 9/1998 | Mackirdy | 27/6 |
| 5,875,529 | A * | 3/1999 | Ollier | 27/6 |
| 6,477,737 | B2 * | 11/2002 | Migli | 16/335 |
| 6,745,442 | B2 * | 6/2004 | Biondo et al. | 27/6 |
| 7,698,792 | B1 * | 4/2010 | Parker | 27/10 |
| 8,353,094 | B2 * | 1/2013 | Parker | 29/525.14 |

* cited by examiner

*Primary Examiner* — William Miller
(74) *Attorney, Agent, or Firm* — Gifford, Krass, Sprinkle, Anderson & Citkowski, P.C.

(57) ABSTRACT

The present invention provides a container having a sheet metal floor, a sheet metal sidewall shell having four round seamless corners and a maximum of two sidewall seams. The container can be a casket with a lid, and a pair of hinges pivotally attaching the lid to the sidewall. The sheet metal sidewall shell can be made from a stretch-bent sheet metal sidewall panel. In some instances, the sheet metal sidewall shell has only one seam that may or may not be a welded seam.

12 Claims, 5 Drawing Sheets

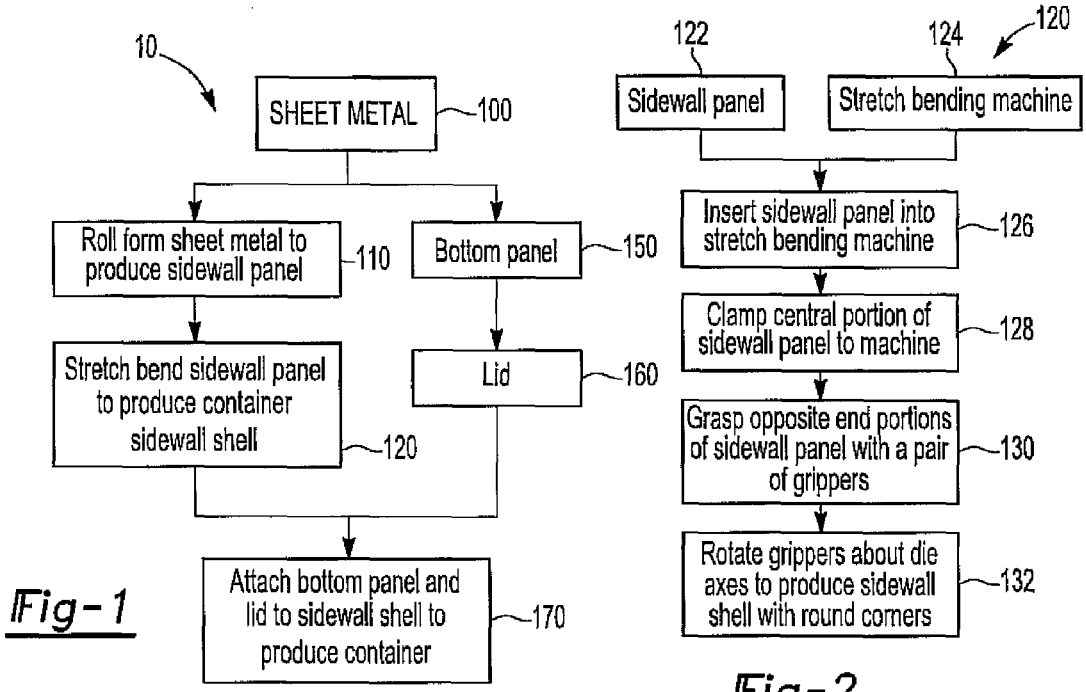
Fig-1
Fig-2
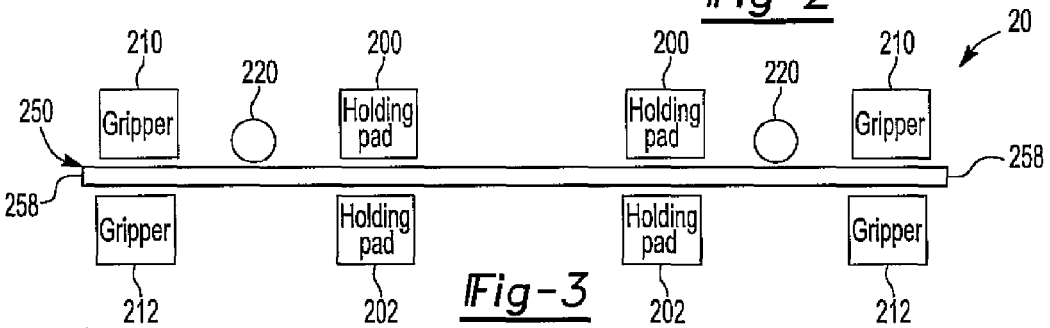
Fig-3
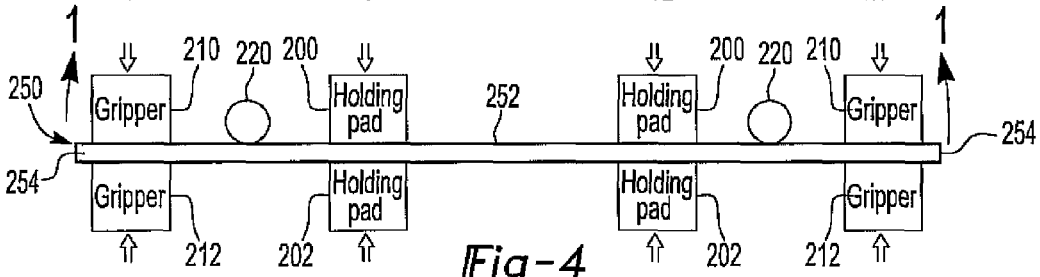
Fig-4
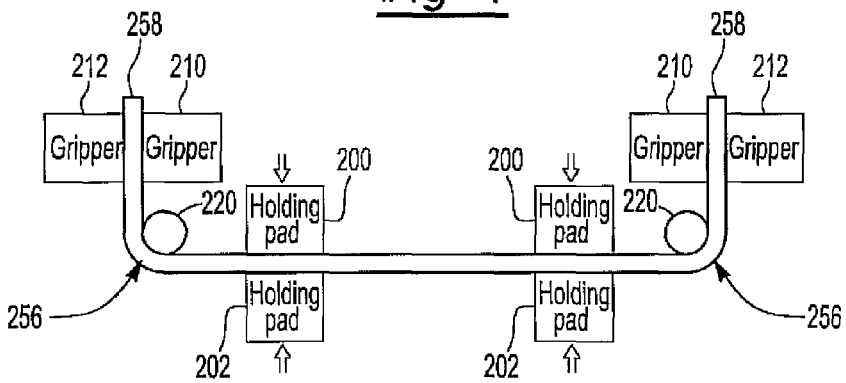
Fig-5

CASKET

CROSS-REFERENCE TO RELATED APPLICATIONS

This application is a continuation-in-part and claims priority of U.S. patent application Ser. No. 13/080,306 having the same title and filed on Apr. 5, 2011, which in turn claims priority of U.S. Provisional Patent Application No. 61/321,099 filed on Apr. 5, 2010, both of which are incorporated herein in their entirety by reference.

FIELD OF THE INVENTION

The present invention relates generally to a casket, and in particular to a casket formed by stretch bending and having stretch-bent corners.

BACKGROUND OF THE INVENTION

Caskets made out of sheet metal are known. Such caskets typically have a sidewall shell, a floor or bottom, and a lid that is pivotally attached to the sidewall shell. In addition, the sidewalls, bottom, lid, etc., are typically made by stamping, roll forming, shearing and the like. However, heretofore sheet metal caskets have four sidewall panels that require welding of the seams between the panels followed by grinding, brushing, etc.

Welding and finishing of such seams naturally requires labor and/or expense to provide a smooth surface, and thereby increases the price of the casket. In addition, each seam within a casket sidewall can provide a location for failure due to increased corrosion, cracking, and the like. Therefore, a casket having at most two sidewall seams could reduce the cost and increase the quality of the casket and thus would be desirable. A process for making such a casket would also be desirable.

The lid of a casket is also a critical component and must be operable to be opened and closed in a smooth and safe manner. For example, it is undesirable for a casket lid to close in an uncontrolled manner since relatives, friends, etc. at a viewing of a deceased individual within a casket could be emotionally upset if the casket lid were to accidentally move from an open position to the closed position in a freefalling manner such that the lid "slammed" shut. Therefore, a casket lid that has one or more hinges that provide for controlled movement between the open position and the closed position would be desirable.

SUMMARY OF THE INVENTION

The present invention provides a casket having a sheet metal floor, a sheet metal sidewall having rounded corners and a maximum of two sidewall seams, a lid, and a pair of hinges pivotally attaching the lid to the sidewall. The sheet metal sidewall can be a stretch-bent sheet metal sidewall and the maximum two sidewall seams can be welded sidewall seams. The sheet metal floor can be welded to the sheet metal sidewall and the maximum two sidewall seams can be located along end sections of the casket or, in the alternative, along side sections of the casket sidewall. In some instances, the sheet metal sidewall has only one seam that may or may not be a welded seam.

The pair of hinges can provide for a "self-locating" lid with each hinge having a double torsion spring with two spaced-apart torsion springs and a generally C-shaped section adjoining the two spaced-apart torsion springs. Each hinge also has a cam that engages with the C-shaped section of the double torsion spring such that the lid can be moved from an open position to a closed position without excessive force and yet remains at a partially open position when force to close the casket lid is removed before the lid is totally closed. The double torsion spring can be attached to the sheet metal sidewall or the lid with the cam attached to the lid or sidewall, respectively.

In some instances, each hinge can have a base plate attached to the sheet metal sidewall or the lid, the two spaced-apart torsion springs being attached to the base plate. The base plate can be rigidly attached to a bottom flange of the lid and have a back edge flange that may or may not provide support for the base plate attached to the lid. The back edge flange can be proximate to and/or abut against a back portion of the lid and thus uses the back portion of the lid to provide support to the base plate and/or bottom flange of the lid.

The cam can be a gooseneck-shaped rod that engages the C-shaped section of the double torsion spring. The gooseneck-shaped rod can have a pivot end pivotally attached to the base plate and a distal end that extends through and affords for attachment to the sheet metal sidewall or lid. In some instances, the C-shaped section of the double torsion spring can have a bearing that engages the gooseneck-shaped rod and provides for smooth and quiet movement of the hinge and/or lid.

The present invention also provides a process for making a container such as a casket having a bottom, a sidewall, and a top, the process including providing a stretch-bending machine having a holding pad and a pair of spaced-apart grippers. A sheet metal bottom panel, a lid, and a sheet metal sidewall panel are also provided with the sheet metal sidewall panel placed into the stretch-bending machine. A central portion of the sidewall panel is held with the holding pad and the pair of spaced-apart grippers grasp oppositely disposed end portions of the sidewall panel. Thereafter, each of the spaced-apart grippers is rotated about a die axis such that the sidewall panel is stretch bent and has a pair of spaced-apart stretch-bent corners and a pair of opposite ends. A seam that contains at least one of the opposite ends of the sheet metal stretch-bent sidewall panel is joined such that a continuous sidewall for the container is formed. In addition, the bottom panel and the lid are attached to the continuous sidewall to form a container.

In some instances, the seam contains both of the opposite ends of the stretch-bent sidewall panel and the continuous sidewall has only one sidewall seam. In other instances, the seam is a first seam that contains one of the opposite ends of the stretch-bent sidewall and an opposite end from another stretch-bent sidewall and the continuous sidewall has a second seam. The one or two seams can be joined by welding and the bottom panel and the lid can be attached to the pair of sheet metal sidewalls by welding and at least a pair of hinges, respectively. The pair of hinges can provide a self-locating lid attached to the continuous sidewall.

BRIEF DESCRIPTION OF THE DRAWINGS

FIG. 1 is a schematic illustration of a process according to an embodiment of the present invention;

FIG. 2 is a schematic illustration of a process according to an embodiment of the present invention;

FIG. 3 is a schematic illustration of a stretch-bending machine being loaded with a sheet metal panel;

FIG. 4 is a schematic illustration of the stretch-bending machine shown in FIG. 3 with the sheet metal panel being held by a holding pad and a gripper;

FIG. 5 is a schematic illustration of the stretch-bending machine shown in FIG. 3 with the sheet metal panel having been stretch bent to have two spaced-apart round corners;

DETAILED DESCRIPTION OF THE PRESENT INVENTION

Figures 6, 7:
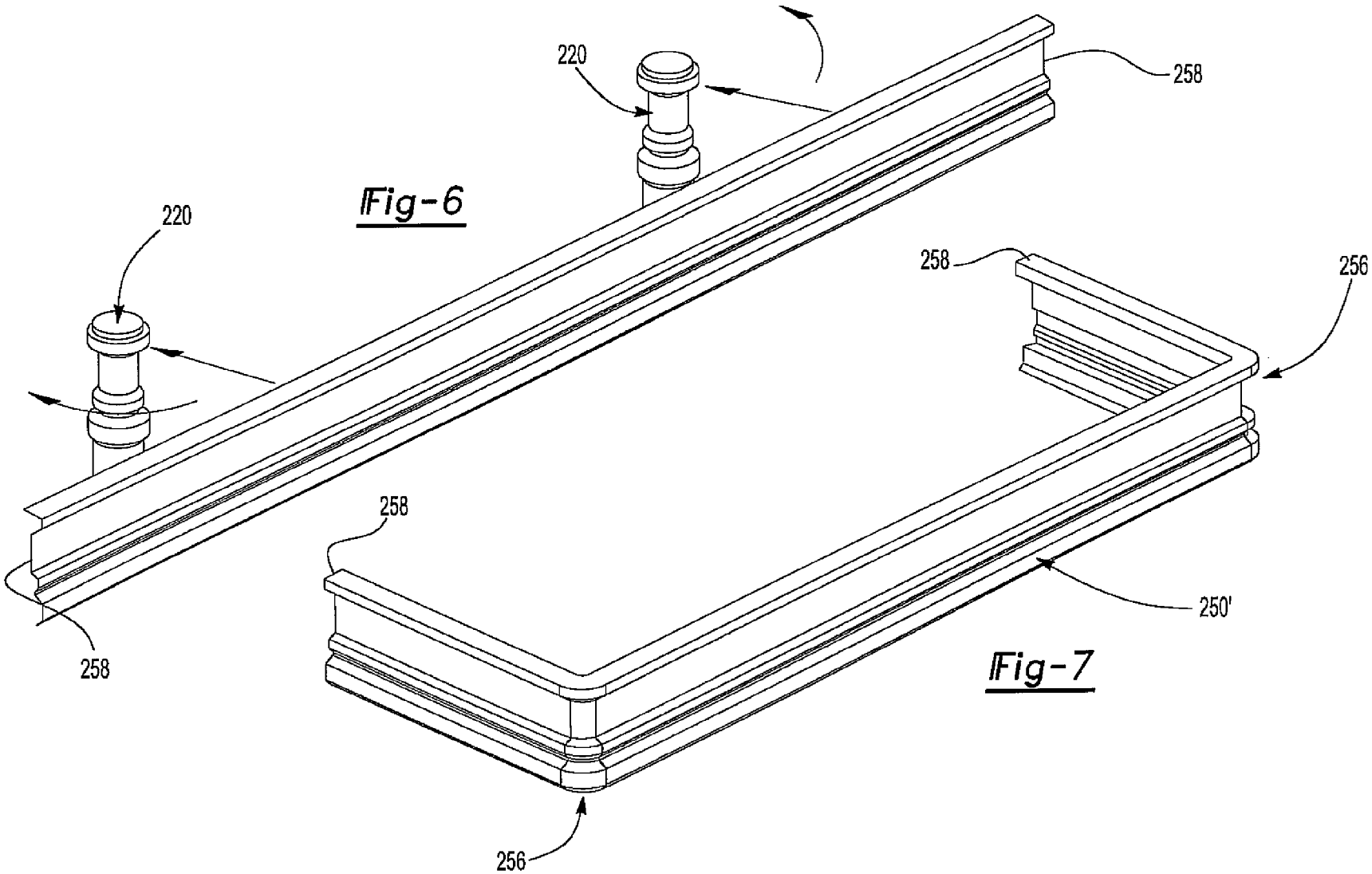
FIG. 6 is a schematic illustration of a sidewall panel to be stretch bent.
FIG. 7 is a schematic illustration of a sidewall panel that has been stretch bent and has two stretch-bent corners.

The present invention provides a process for making a container that requires a sidewall with four round seamless corners and a maximum of two sidewall seams. As such, the present invention has utility for making a container.

The process can be used to make containers such as caskets; however, this is not required. The containers typically have a sidewall shell, a bottom, and a top or lid. The lid can be pivotally attached to the sidewall shell and be moved between a closed position and an open position. The sidewall shell is in the shape of a rectangle and can be made from one or more sidewall panels. The one or more sidewall panels can be stretch-bent to produce at least two round seamless corners from each panel and the sidewall panel may or may not be roll-formed, stamped etc., such that it has a desired sidewall arcuate profile. In some instances, a first sidewall panel can be stretch-bent to produce a first sidewall shell half and a second sidewall panel can be stretch-bent to produce a second sidewall shell half. Both of the sidewall shell halves have opposite ends that afford for two seams when the first and second halves are properly aligned opposite each other. In addition, the opposite ends of the first and second sidewall shell halves can be joined together such that a continuous sidewall shell is provided. The bottom can be attached to the continuous sidewall shell, as can be the lid. It is appreciated that by having a continuous sidewall shell with at most two sidewall seams, reduced labor and cost is required to make the container.

In some instances, a single sidewall panel can be stretch-bent to produce a complete sidewall shell with four seamless round corners and only one seam. In this manner, even less labor and expense can be required to produce a container.

The lid can be pivotally attached to the continuous sidewall shell using at least a pair of hinges with at least one of the hinges having a double torsion spring and a cam that engages the double torsion spring. The double torsion spring can have two spaced-apart torsion springs and a C-shaped section that adjoins the two spaced-apart torsion springs with the cam engaging the C-shaped section. The two spaced-apart torsion springs can be attached to the lid of the container and the cam can be attached to the sidewall shell. In the alternative, the two spaced-apart torsion springs can be attached to the sidewall shell and the cam can be attached to the lid. The cam can be in the form of a gooseneck-shaped rod that engages the C-shaped section of the double torsion spring, the gooseneck-shaped rod having a pivot end that is pivotally attached to the same component that the two spaced-apart torsion springs are attached to, i.e. either the shell or the lid, and a distal end that is attached to the opposing component, i.e. the lid or the shell, respectively.

The hinge can also have a base plate that is attached to either the sidewall shell or the lid, the base plate also having the two spaced-apart torsion springs attached thereto. Furthermore, the base plate can serve as a pivot attachment point or location for the pivot end of the gooseneck-shaped rod.

Turning now to FIG. 1, a process for making a container is shown generally at reference numeral 10. The process 10 can include providing sheet metal at step 100, the sheet metal 100 being used to provide sidewall panels by roll forming, stamping, shearing and the like at step 110. The sidewall panels are stretch bent to produce a sidewall shell having one or more stretch-bent round corners at step 120. The sheet metal also affords for a bottom panel at step 150 and a lid at step 160 which are attached to the sidewall shell at step 170.

Referring to FIG. 2, the process of stretch-bending the sidewall panels 120 can include providing a sidewall panel at step 122 and a stretch-bending machine at step 124. The sidewall panel is inserted into the stretch-bending machine at step 126 with a central portion of the panel clamped to the machine at step 128. Opposite end portions of the sidewall panel are grasped with a pair of spaced-apart grippers at step 130 and the grippers rotate about die axes to produce a sidewall shell with round seamless corners at step 132. For the purpose of the present invention, the term round seamless corners refers to corners that do not have a seam and have a radius of curvature of at least 1 centimeter (cm), preferable at least 2 cm, more preferably at least 3 cm, and still more preferably at least 5 cm.

FIG. 3 provides a schematic illustration of the stretch-bending machine at reference numeral 20. The stretch-bending machine 20 can have a pair of inner holding pads 200 and a pair of oppositely disposed outer holding pads 202. The machine 20 also has a pair of spaced-apart grippers that can include a pair of inner grippers 210 with a pair of oppositely disposed outer grippers 212. A sheet metal panel 250 having opposite ends 258 can be inserted between the inner holding pads 200, inner grippers 210 and the outer holding pads 202, outer grippers 212. A pair of corner dies 220 is also located on an inner side of the sheet metal panel.

A central portion 252 of the panel 250 can be grasped by at least one of the outer holding pads 202 moving in an inward direction. It is appreciated that the panel 250 can also be grasped by an inner holding pad 200 moving in an outer direction. Oppositely disposed end portions 254 of the panel 250 are also grasped by the pair of oppositely disposed grippers by, for example, the outer grippers 212 moving in an inward direction. Thereafter, the grippers move in a direction 1 such that the panel 250 is stretched and bent around the dies 220 to form round seamless corners 256 as shown in FIG. 5. It is appreciated that the material of the round corners 256 can undergo plastic deformation and thus provide additional strength to the panel 250.

After the panel 250 has been stretch bent as illustrated in FIG. 5, the holding pad 202 and grippers 212 can move in an outer direction such that the panel 250 can be removed from the machine 20. Although FIGS. 3-5 illustrate a panel having two round seamless corners, it is appreciated that a machine can be provided such that four round seamless corners are provided from a single panel and opposite ends 258 are proximate to each other such that a single seam between the edges 258 is produced. In the alternative, and as shown by FIG. 5, sidewall shell halves can be produced by the machine 20 with two halves with ends 258 arranged proximate to each other such that two seams are provided, joined and are present within the sidewall of a generally rectangular shaped shell.

Figure 8:
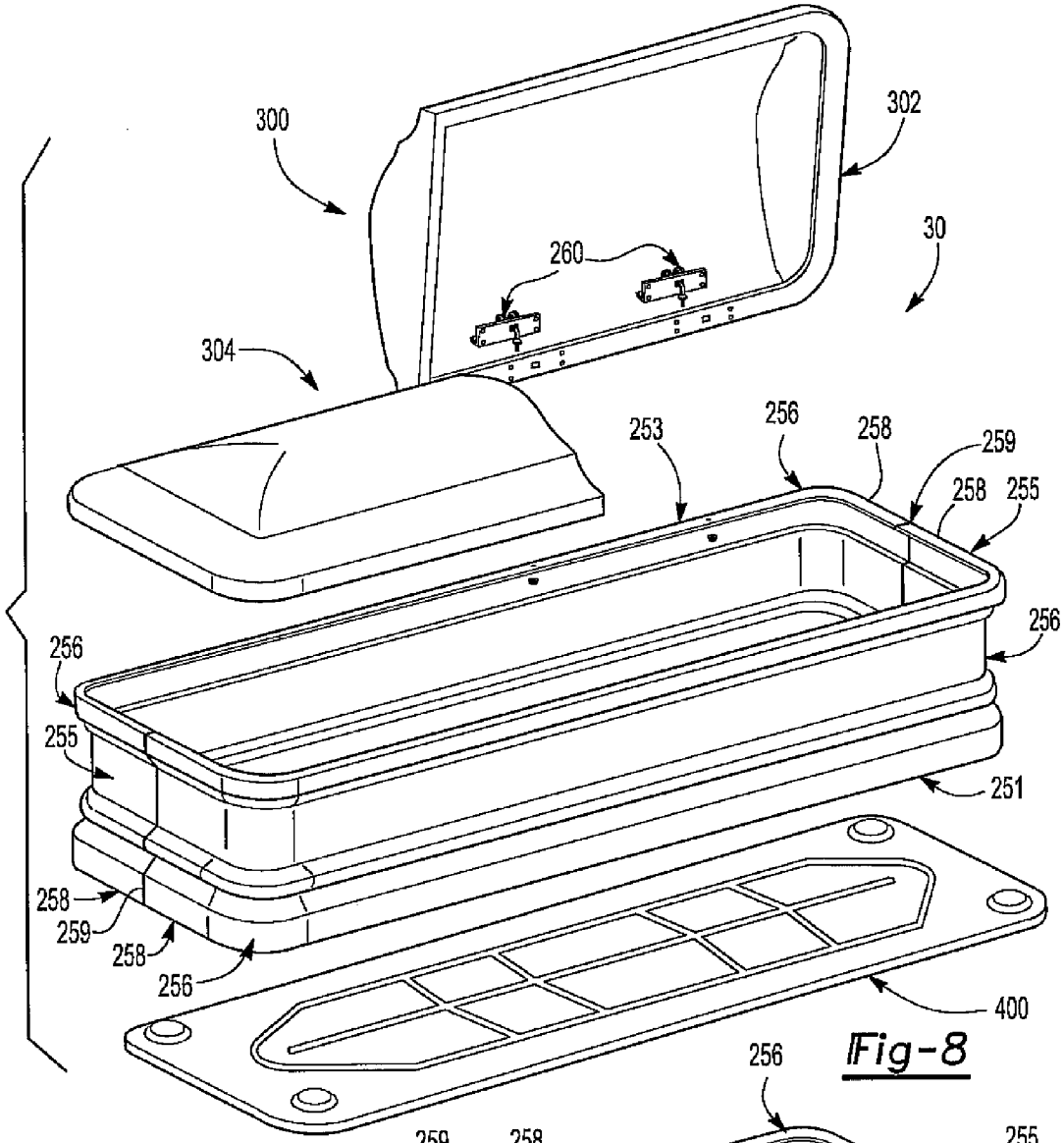
FIG. 8 is a schematic illustration of a container having a stretch-bent sidewall with two seams, the stretch-bent sidewall to have a bottom and a lid attached thereto.

FIG. 6 provides a schematic illustration of the sidewall panel 250 having an arcuate sidewall profile that can be provided by roll forming, stamping, and the like. The panel 250 is bent around corner die axes 220 to produce the sidewall shell half 250' with two round seamless corners 256 illustrated in FIG. 7. Taking a pair of the sidewall panels 250' and arranging them opposite each other such that the opposite edges 258 from opposite panels are proximate to each other as shown in FIG. 8 provides for a pair of seams 259 and a rectangular shaped shell with four round seamless corners. The seams 259 can be welded such that the ends 258 of each panel 250' are attached to each other and a generally rectangular shaped sidewall shell 251 is provided. It is appreciated that other joining techniques and processes can be used to attach the two shell halves together, for example and for illustrative purposes only, threaded fasteners, rivets, adhesives, and the like can be used. It is also appreciated that the opposite ends 258 can be cut, trimmed, etc., in order to produce ends with a desired finish, a desired sidewall panel length and the like and the seams 259 can be located along side or lengthwise portions 253 of the sidewall shell 251, or in the alternative, along end portions 255 of the shell 251.

Figure 9:
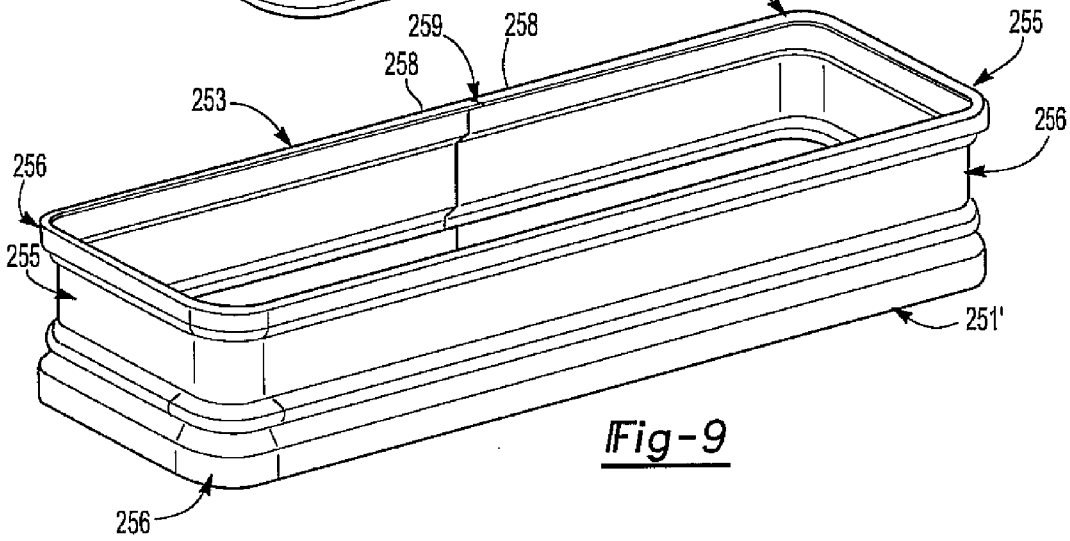
FIG. 9 is a schematic illustration of a container having a stretch-bent sidewall with one seam.
Figure 10:
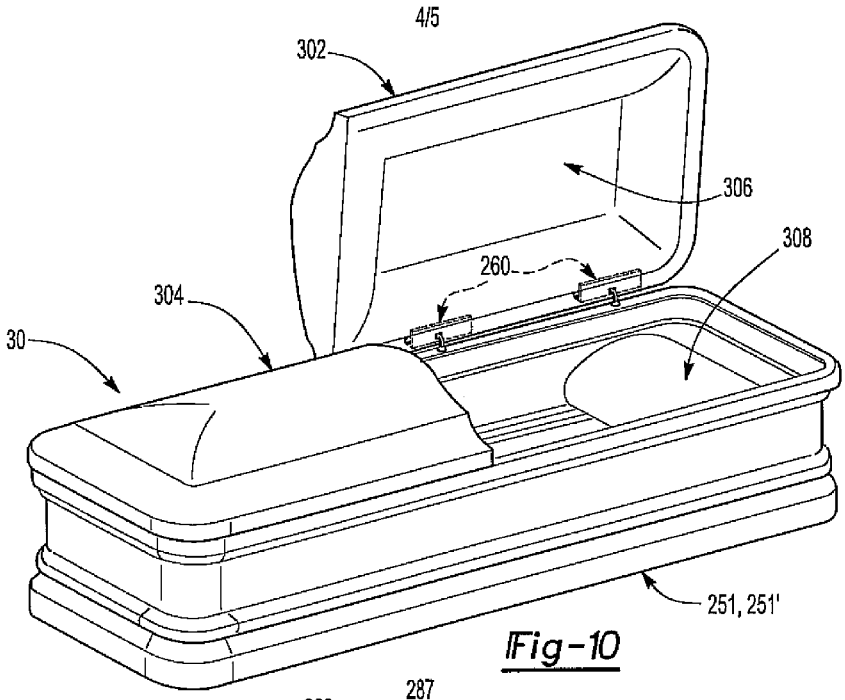
FIG. 10 is a schematic illustration of a container in the form of a casket.

Before, during, and/or after the seams 259 are joined, a lid 300 and/or bottom 400 can be attached to the sidewall shell 251. In some instances, a sidewall shell 251, bottom 400, and lid 300 can provide a casket 30 as shown in FIGS. 8 and 10. In other instances, a sidewall shell 251□ can be provided by stretch bending a sheet metal panel 250 such that four round seamless corners are provided from a single panel 250 and opposite ends 258 are proximate to each other such that a single seam between the edges 258 is produced as illustrated in FIG. 9. Although the single seam 259 shown in FIG. 9 is located within the side or lengthwise portion 253 of the sidewall shell 251□, it is appreciated that the single seam 259 can be located within one of the end portions 255 of the shell 251□.

The casket 30 can have a full-length lid as known to those skilled in the art or a pair of half lids 302 and 304 as shown in FIGS. 8 and 10. The lid can have a dish 306, in combination with casket puffing material 308, and the lid can be attached to the sidewall shell 251, 251□ using one or more hinges 260.

Figure 11:
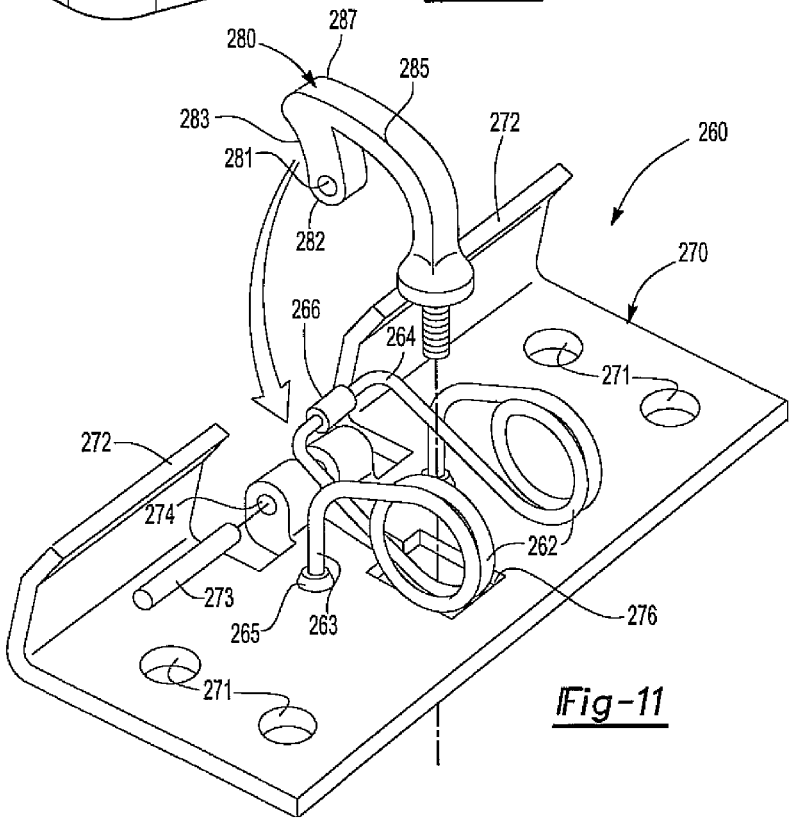
FIG. 11 is a schematic illustration for a hinge according to an embodiment of the present invention.
Figure 12:
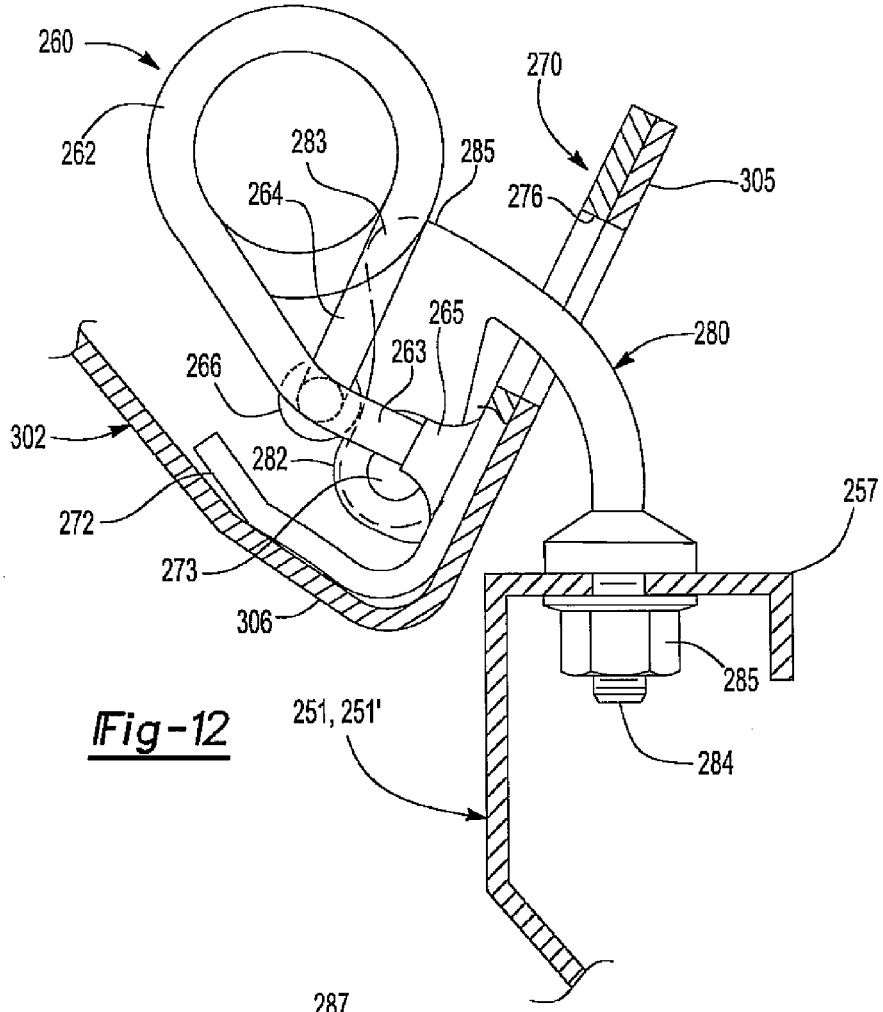
FIG. 12 is a schematic illustration of the hinge shown in FIG. 10 attached to a sidewall and a lid, the lid being in an open position.
Figure 13:
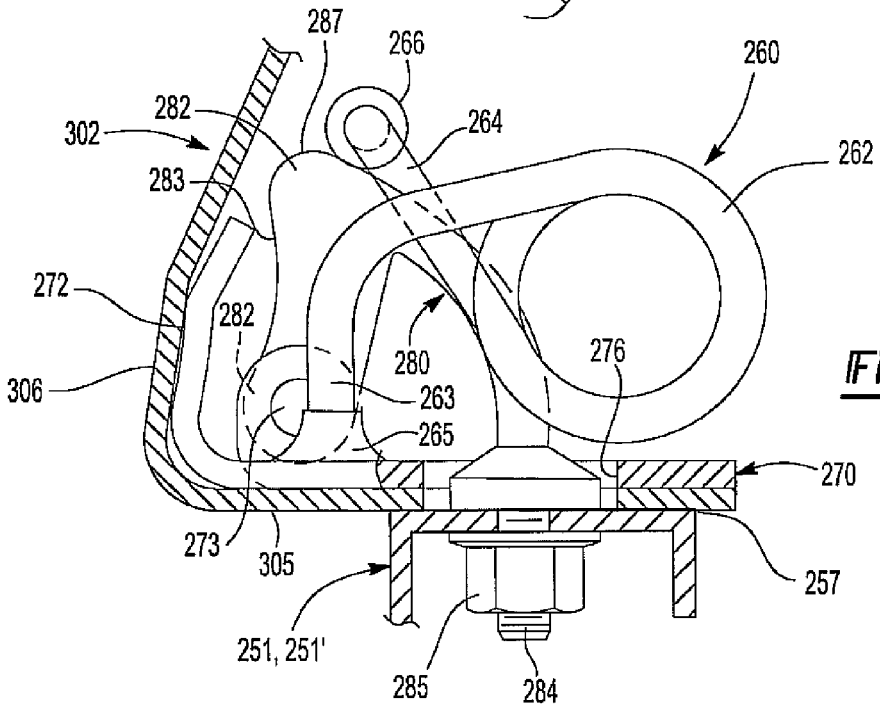
FIG. 13 is a schematic illustration of the hinge shown in FIG. 10 attached to a sidewall and a lid, the lid being in a closed position.

Referring now to FIGS. 11-13, the hinge 260 can include a double torsion spring that has two spaced-apart torsion springs 262 and a C-shaped section 264 adjoining the two spaced-apart torsion springs 262. Spring 260 also has a cam 280 that can engage the C-shaped section 264, and the two spaced-apart torsion springs can be attached to the shell sidewall 251, 251' or the lid 300, and the cam 280 attached to the lid 300 or shell sidewall 251, 251', respectively.

The hinge 260 provides for the lid 300 to be moved from an open position to a closed position in a smooth and controlled manner. In addition, the hinge 260 affords for the lid 300 to be "self-locating", i.e. the lid remains generally at the location between the open position and the closed position where a closing and/or opening force is terminated. In this manner, a lid is prevented from closing and/or opening in an uncontrolled manner.

The hinge 260 can also have a base plate 270 with one or more apertures 271, a backing flange 272, and pivot portion 274. The apertures 271 afford for the base plate 270 to be bolted to a container shell or lid or, in the alternative, the base plate 270 can be attached using welding, adhesives, and the like. The torsion springs 262 can have an attachment end 263 that is attached to the base plate 270, for example using a weld 265. The pivot portion 274 can afford for the cam 280 to have a pivot end 282 with an aperture 281 pivotally attached thereto such that the cam 280 can pivot about a pin 273 through an aperture 274 of the base plate 220 and engage the C-shaped section 264 of the spring 260.

In some instances, a bearing 266 can be attached to the C-shaped section 264 such that the cam 280 engages the bearing 266 and provides for a smooth and quiet interaction/engagement between the cam 280 and the C-shaped section 264. The cam 280 can be a gooseneck-shaped rod with the pivot end 282 and a distal end 284. With the pivot end 282 attached to the base plate 270, the distal end 284 can be attached to a component that the base plate 270 is not attached to. For example and for illustrative purposes only, the base plate 270 can be attached to the lid 300 and the distal end 284 of the cam 280 can be attached to the sidewall shell 251, 251□.

FIGS. 12 and 13 illustrate the base plate 270 and thus the spring 260 being attached to the lid 300, the base plate 270 attached to a lower flange 305 and the back flange 272 being proximate to and/or abutting against a back portion 306 of the lid 302. With the base plate 270 and spring 260 attached to the lid, the distal end 284 can be attached to the sidewall shell flange 257 such that the cam 280 engages the C-shaped section 264 when the lid 300 is moved between an open position and a closed position. In particular, when the lid 300 is moved from the open position to the closed position, the cam 280 is rotated into the C-shaped section 264 such that the torsion springs 262 provide a restraining force against a gooseneck portion 282 of cam 280, and thus against the lid 300. In addition, the restraining force of the spring 260 against the gooseneck portion 282 results in the lid 300 remaining in approximately the same position where it is located when a closing and/or opening force applied to the lid is removed. For example, if a push or pull force is applied to the lid 302 in FIG. 10 until the lid is approximately halfway closed, and then the force on the lid 302 is removed, the lid 302 stays about halfway open until additional force is applied thereto.

It is appreciated that the cam 280, torsion springs 262 and C-shaped section 262 are shaped and located such that the C-shaped section 262 is located on a first side 283 of the gooseneck portion 282 when the lid 300 is in an open position and on a second side 285 of the gooseneck portion 282 when the lid 300 is in a closed position. As such, the pair of torsion springs 262 with C-shaped section 264 and bearing 266 can apply a restraining force against the first side 283 of the gooseneck portion 282 and thereby prevent the lid 300 from a "freefall" closing motion. In addition, once the lid 300 approaches a close distance to the closed position, e.g. within 5 cm, preferably within 2.5 cm and more preferably within 1 cm, the C-shaped section 264 and bearing 266 pass over a knee portion 287 between the first side 283 and second side 285 of the gooseneck portion 282, moves over to the second side 285 and thereby allows the lid to freely close and/or move to the closed position. In this manner and self-locating lid is provided for a container.

The invention is not restricted to the illustrative embodiments described above. The embodiments are not intended as limitations on the scope of the invention. Methods, processes, apparatus, and the like described herein are exemplary and not intended as limitations on the scope of the invention. For example, the container, casket, hinges, and the like described herein can be made from steel, nickel-based alloys, stainless steels, etc. As such, changes herein and other uses will occur to those skilled in the art. The scope of the invention is defined by the scope of the claims.

We claim:

1. A casket comprising:

a sheet metal floor;

a sheet metal sidewall having four corners;

a lid; and a pair of hinges pivotally attaching said lid to said sidewall;

said pair of hinges each having a double torsion spring comprising two spaced-apart torsion springs and a C-shaped section adjoining said two spaced-apart torsion springs, each of said pair of hinges also having a cam engaged with said C-shaped section of said double torsion spring, said pair of hinges providing a self-locating lid on said sheet metal sidewall.

2. The casket of claim 1, wherein said sheet metal sidewall is a stretch-bent sheet metal sidewall.

3. The casket of claim 2, wherein said sidewall has a maximum of two sidewall seams.

4. The casket of claim 3, wherein said sheet metal sidewall has a pair of end sections, said maximum of two sidewall seams located within said pair of end sections.

5. The casket of claim 1, wherein said sheet metal floor is welded to said sheet metal sidewall.

6. The casket of claim 1, wherein said double torsion spring is attached to one of said sheet metal sidewall and said lid, and said cam is attached one of said sheet metal sidewall and said lid that does not have said double torsion spring attached thereto.

7. The casket of claim 6, wherein each of said hinges has a base plate attached to one of said sheet metal sidewall and said lid, said two spaced-apart torsion springs attached to said base plate.

8. The casket of claim 7, wherein said base plate is rigidly attached to said lid and has a back edge lip adjacent to a back portion of said lid.

9. The casket of claim 8, wherein said back edge lip provides support for said base plate on said lid.

10. The casket of claim 1, wherein said cam is a gooseneck-shaped rod that engages said C-shaped section of said double torsion spring.

11. The casket of claim 10, further comprising a bearing on said C-shaped section of said double torsion spring, said gooseneck-shaped rod engaging said bearing.

12. The casket of claim 11, wherein said bearing is a sleeve on said C-shaped section.

* * * * *